US007901569B2

(12) United States Patent
Farshid et al.

(10) Patent No.: US 7,901,569 B2
(45) Date of Patent: Mar. 8, 2011

(54) PROCESS FOR UPGRADING HEAVY OIL USING A REACTOR WITH A NOVEL REACTOR SEPARATION SYSTEM

(75) Inventors: Darush Farshid, Larkspur, CA (US); James Murphy, Vallejo, CA (US); Bruce Reynolds, Martinez, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 240 days.

(21) Appl. No.: 12/212,231

(22) Filed: Sep. 17, 2008

(65) Prior Publication Data

US 2009/0057194 A1 Mar. 5, 2009

Related U.S. Application Data

(63) Continuation of application No. 11/303,427, filed on Dec. 16, 2005, now Pat. No. 7,431,822.

(51) Int. Cl.
*C10G 1/08* (2006.01)

(52) U.S. Cl. ..... 208/413; 208/13; 208/418; 208/419; 208/428

(58) Field of Classification Search ..... None
See application file for complete search history.

(56) References Cited

U.S. PATENT DOCUMENTS 3,817,856 A 6/1974 Aaron et al.
4,485,004 A 11/1984 Fisher et al.
4,592,827 A 6/1986 Galiasso et al.
4,684,456 A 8/1987 Van Driesen et al.
4,710,486 A 12/1987 Lopez et al.
4,824,821 A 4/1989 Lopez et al.
4,943,547 A 7/1990 Seamans et al.
4,970,190 A 11/1990 Lopez et al.
5,039,392 A 8/1991 Bearden et al.
5,041,404 A 8/1991 Seamans et al.
5,162,282 A 11/1992 Lopez et al.
5,164,075 A 11/1992 Lopez et al.
5,178,749 A 1/1993 Lopez et al.
5,298,152 A 3/1994 Kramer et al.
5,371,308 A 12/1994 Gosselink et al.
5,374,348 A 12/1994 Sears et al.
5,484,755 A 1/1996 Lopez et al.
5,527,473 A 6/1996 Ackerman
5,871,638 A 2/1999 Pradhan et al.
5,914,010 A 6/1999 Hood et al.
5,925,238 A 7/1999 Duddy et al.
5,935,418 A 8/1999 Chakrabarty et al.
5,954,945 A 9/1999 Cayton et al.
5,977,192 A 11/1999 Howsmon et al.
6,071,402 A 6/2000 Danot et al.
6,139,723 A 10/2000 Pelrine et al.
6,156,693 A 12/2000 Song et al.
6,156,695 A 12/2000 Soled et al.
6,162,350 A 12/2000 Soled et al.

(Continued)

*Primary Examiner* — Tam M Nguyen

(57) ABSTRACT

Applicants have developed a new residuum full hydroconversion slurry reactor system that allows the catalyst, unconverted oil, hydrogen, and converted oil to circulate in a continuous mixture throughout an entire reactor with no confinement of the mixture. The mixture is separated internally, within one of more of the reactors, to separate only the converted oil and hydrogen into a vapor product while permitting the unconverted oil and the slurry catalyst to continue on into the next sequential reactor as a liquid product. A portion of the unconverted oil is then converted to lower boiling point hydrocarbons in the next reactor, once again creating a mixture of unconverted oil, hydrogen, converted oil, and slurry catalyst. Further hydroprocessing may occur in additional reactors, fully converting the oil. The oil may alternately be partially converted, leaving a concentrated catalyst in unconverted oil which can be recycled directly to the first reactor.

7 Claims, 1 Drawing Sheet

U.S. PATENT DOCUMENTS

| | | | |
|---|---|---|---|
| 6,190,542 | B1 | 2/2001 | Comolli et al. |
| 6,241,874 | B1 | 6/2001 | Wallace et al. |
| 6,270,654 | B1 | 8/2001 | Colyar et al. |
| 6,274,530 | B1 | 8/2001 | Cayton et al. |
| 6,277,895 | B1 | 8/2001 | Zhou et al. |
| 6,278,034 | B1 | 8/2001 | Espinoza et al. |
| 6,291,391 | B1 | 9/2001 | MacArthur et al. |
| 6,299,760 | B1 | 10/2001 | Soled et al. |
| 6,451,729 | B1 | 9/2002 | Song et al. |
| 6,534,437 | B2 | 3/2003 | Eijsbouts et al. |
| 6,554,994 | B1 | 4/2003 | Reynolds et al. |
| 6,620,313 | B1 | 9/2003 | Demmin et al. |
| 6,630,066 | B2 | 10/2003 | Cash et al. |
| 6,635,599 | B1 | 10/2003 | Eijsbouts et al. |
| 6,652,738 | B2 | 11/2003 | Eijsbouts et al. |
| 6,660,157 | B2 | 12/2003 | Que et al. |
| 6,712,955 | B1 | 3/2004 | Hou et al. |
| 6,726,832 | B1 | 4/2004 | Baldassari et al. |
| 6,758,963 | B1 | 7/2004 | Hantzer et al. |
| 7,150,823 | B2 | 12/2006 | Mayer et al. |
| 7,179,366 | B2 | 2/2007 | Harle et al. |
| 7,214,308 | B2 | 5/2007 | Colyar |
| 7,223,713 | B2 | 5/2007 | Alonso et al. |
| 7,232,515 | B1 | 6/2007 | Demmin et al. |
| 7,297,250 | B2 | 11/2007 | Bronicki |
| 7,358,413 | B2 | 4/2008 | Stell et al. |
| 7,413,669 | B2 | 8/2008 | Gonzalez et al. |
| 7,416,653 | B2 | 8/2008 | Wellington et al. |
| 2002/0010088 | A1 | 1/2002 | Eijsbouts et al. |
| 2002/0125172 | A1 | 9/2002 | Que et al. |
| 2002/0166797 | A1 | 11/2002 | Banerjee |
| 2003/0089636 | A1 | 5/2003 | Marchionna et al. |
| 2003/0102254 | A1 | 6/2003 | Eijsbouts et al. |
| 2003/0150778 | A1 | 8/2003 | Haluska et al. |
| 2004/0134837 | A1 | 7/2004 | Dassori et al. |
| 2004/0163999 | A1 | 8/2004 | Plantega et al. |
| 2004/0226860 | A1 | 11/2004 | Bourges et al. |
| 2005/0040080 | A1 | 2/2005 | Riley et al. |
| 2005/0145538 | A1 | 7/2005 | Wellington et al. |
| 2005/0145543 | A1 | 7/2005 | Bhan et al. |
| 2005/0150818 | A1 | 7/2005 | Bhan et al. |
| 2005/0155908 | A1 | 7/2005 | Bhan et al. |
| 2005/0167320 | A1 | 8/2005 | Bhan et al. |
| 2005/0167321 | A1 | 8/2005 | Wellington et al. |
| 2005/0167322 | A1 | 8/2005 | Wellington et al. |
| 2005/0167323 | A1 | 8/2005 | Wellington et al. |
| 2005/0167324 | A1 | 8/2005 | Bhan et al. |
| 2005/0167326 | A1 | 8/2005 | Bhan et al. |
| 2005/0167327 | A1 | 8/2005 | Bhan et al. |
| 2005/0167328 | A1 | 8/2005 | Bhan et al. |
| 2005/0167329 | A1 | 8/2005 | Bhan et al. |
| 2005/0167330 | A1 | 8/2005 | Bhan et al. |
| 2005/0167331 | A1 | 8/2005 | Bhan et al. |
| 2005/0167332 | A1 | 8/2005 | Bhan et al. |
| 2005/0173298 | A1 | 8/2005 | Wellington et al. |
| 2005/0173301 | A1 | 8/2005 | Bhan et al. |
| 2005/0173302 | A1 | 8/2005 | Bhan et al. |
| 2005/0173303 | A1 | 8/2005 | Bhan et al. |
| 2005/0241992 | A1 | 11/2005 | Lott et al. |
| 2005/0241993 | A1 | 11/2005 | Lott et al. |
| 2006/0011511 | A1 | 1/2006 | Hokari et al. |
| 2006/0054535 | A1 | 3/2006 | Chen et al. |
| 2006/0060501 | A1 | 3/2006 | Gauthier et al. |
| 2006/0060502 | A1 | 3/2006 | Soled et al. |
| 2006/0060503 | A1 | 3/2006 | Soled et al. |
| 2006/0157385 | A1 | 7/2006 | Montanari et al. |
| 2006/0163115 | A1 | 7/2006 | Montanari et al. |
| 2006/0175229 | A1 | 8/2006 | Montanari et al. |
| 2006/0186021 | A1 | 8/2006 | Marchionna et al. |
| 2006/0201854 | A1 | 9/2006 | Lott et al. |
| 2006/0207917 | A1 | 9/2006 | Domokos et al. |
| 2006/0231465 | A1 | 10/2006 | Bhan et al. |
| 2006/0272982 | A1 | 12/2006 | Montanari et al. |
| 2006/0289340 | A1 | 12/2006 | Brownscombe et al. |
| 2007/0000808 | A1 | 1/2007 | Bhan et al. |
| 2007/0000810 | A1 | 1/2007 | Bhan et al. |
| 2007/0012595 | A1 | 1/2007 | Brownscombe et al. |
| 2007/0045156 | A1 | 3/2007 | Khadzhiev et al. |
| 2007/0084754 | A1 | 4/2007 | Soled et al. |
| 2007/0090023 | A1 | 4/2007 | Soled et al. |
| 2007/0090024 | A1 | 4/2007 | Soled et al. |
| 2007/0158236 | A1 | 7/2007 | Zhou et al. |
| 2007/0158238 | A1 | 7/2007 | Wu et al. |
| 2007/0161505 | A1 | 7/2007 | Pereira-Almao et al. |
| 2007/0238607 | A1 | 10/2007 | Alonso et al. |
| 2007/0284285 | A1 | 12/2007 | Stepanik et al. |
| 2007/0295641 | A1 | 12/2007 | Brownscombe et al. |
| 2007/0295645 | A1 | 12/2007 | Brownscombe et al. |
| 2007/0295646 | A1 | 12/2007 | Bhan et al. |
| 2007/0295647 | A1 | 12/2007 | Brownscombe et al. |
| 2008/0083650 | A1 | 4/2008 | Bhan et al. |
| 2008/0083652 | A1 | 4/2008 | Morel et al. |
| 2008/0083655 | A1 | 4/2008 | Bhan et al. |
| 2008/0085225 | A1 | 4/2008 | Bhan et al. |
| 2008/0087575 | A1 | 4/2008 | Bhan et al. |
| 2008/0087578 | A1 | 4/2008 | Bhan et al. |
| 2008/0099371 | A1 | 5/2008 | McCoy et al. |

PROCESS FOR UPGRADING HEAVY OIL USING A REACTOR WITH A NOVEL REACTOR SEPARATION SYSTEM

CROSS REFERENCE TO RELATED APPLICATIONS

This application is a continuation of U.S. patent application Ser. No. 11/303,427 with a filing date of Dec. 16, 2005 now U.S. Pat. No. 7,431,822, the disclosure of which is incorporated herein by reference.

FIELD OF THE INVENTION

The instant invention relates to a process for upgrading heavy oils using a slurry catalyst composition.

BACKGROUND OF THE INVENTION

There is an increased interest at this time in the processing of heavy oils, due to larger worldwide demand for petroleum products. Canada and Venezuela are sources of heavy oils. Processes which result in complete conversion of heavy oil feeds to useful products are of particular interest.

U.S. Pat. No. 6,278,034 recites a hydrogenation process which employs a reactor having an internal means of separating gaseous product from a slurry of oil and catalyst.

The following patent applications, which are incorporated by reference, are directed to the preparation of highly active slurry catalyst compositions and their use in processes for upgrading heavy oil:

U.S. Ser. No. 10/938,202 is directed to the preparation of a catalyst composition suitable for the hydroconversion of heavy oils. The catalyst composition is prepared by a series of steps, involving mixing a Group VIB metal oxide and aqueous ammonia to form an aqueous mixture, and sulfiding the mixture to form a slurry. The slurry is then promoted with a Group VIII metal. Subsequent steps involve mixing the slurry with a hydrocarbon oil and combining the resulting mixture with hydrogen gas and a second hydrocarbon oil having a lower viscosity than the first oil. An active catalyst composition is thereby formed.

U.S. Ser. No. 10/938,003 is directed to the preparation of a slurry catalyst composition. The slurry catalyst composition is prepared in a series of steps, involving mixing a Group VIB metal oxide and aqueous ammonia to form an aqueous mixture and sulfiding the mixture to form a slurry. The slurry is then promoted with a Group VIII metal. Subsequent steps involve mixing the slurry with a hydrocarbon oil, and combining the resulting mixture with hydrogen gas (under conditions which maintain the water in a liquid phase) to produce the active slurry catalyst.

U.S. Ser. No. 10/938,438 is directed to a process employing slurry catalyst compositions in the upgrading of heavy oils. The slurry catalyst composition is not permitted to settle, which would result in possible deactivation. The slurry is recycled to an upgrading reactor for repeated use and products require no further separation procedures for catalyst removal.

U.S. Ser. No. 10/938,200 is directed to a process for upgrading heavy oils using a slurry composition. The slurry composition is prepared in a series of steps, involving mixing a Group VIB metal oxide with aqueous ammonia to form an aqueous mixture and sulfiding the mixture to form a slurry. The slurry is then promoted with a Group VIII metal compound. Subsequent steps involve mixing the slurry with a hydrocarbon oil, and combining the resulting mixture with hydrogen gas (under conditions which maintain the water in a liquid phase) to produce the active slurry catalyst.

U.S. Ser. No. 10/938,269 is directed to a process for upgrading heavy oils using a slurry composition. The slurry composition is prepared by a series of steps, involving mixing a Group VIB metal oxide and aqueous ammonia to form an aqueous mixture, and sulfiding the mixture to form a slurry. The slurry is then promoted with a Group VIII metal. Subsequent steps involve mixing the slurry with a hydrocarbon oil and combining the resulting mixture with hydrogen gas and a second hydrocarbon oil having a lower viscosity than the first oil. An active catalyst composition is thereby formed.

SUMMARY OF THE INVENTION

A process for the hydroconversion of heavy oils, said process employing an upflow reactor with a separator located internally to do phase separation. At least one reactor with an internal separator may be employed, although it is more common to use reactors in series. A hydroconversion process with reactors in series may employ the following steps: (a) combining a heated heavy oil feed, an active slurry catalyst composition and a hydrogen-containing gas to form a mixture; (b) passing the mixture of step (a) to the bottom of a reactor, which is maintained at hydroprocessing conditions, including elevated temperature and pressure; (c) separating internally in the reactor a stream comprising reaction products, hydrogen gas, unconverted oil, and slurry catalyst into two streams, a vapor stream comprising reaction products and hydrogen, and a liquid stream comprising unconverted material and slurry catalyst; (d) passing the vapor stream overhead to further processing, and passing at least a portion of the liquid stream, to the next reactor in series.

This invention is intended to perform phase separation within one or more reactors in the process scheme depicted, so that a single vapor phase product is the only product leaving the top of the reactor. A liquid phase product is the only stream leaving the lower portion of the reactor (through the bottom or side) for further processing. If internal separation occurs, there is no need for a hot high pressure separator or flash drum to separate the phase following their exit from the reactor.

The instant invention further employs a reactor differential pressure control system that regulates the vapor product leaving the top of the reactor, thus making a control valve on the feed stream to the next reactor unnecessary.

BRIEF DESCRIPTION OF THE FIGURE

The FIGURE shows the process scheme of this invention as applied to a multiple reactor system in series.

DETAILED DESCRIPTION OF THE INVENTION

Figure 1:
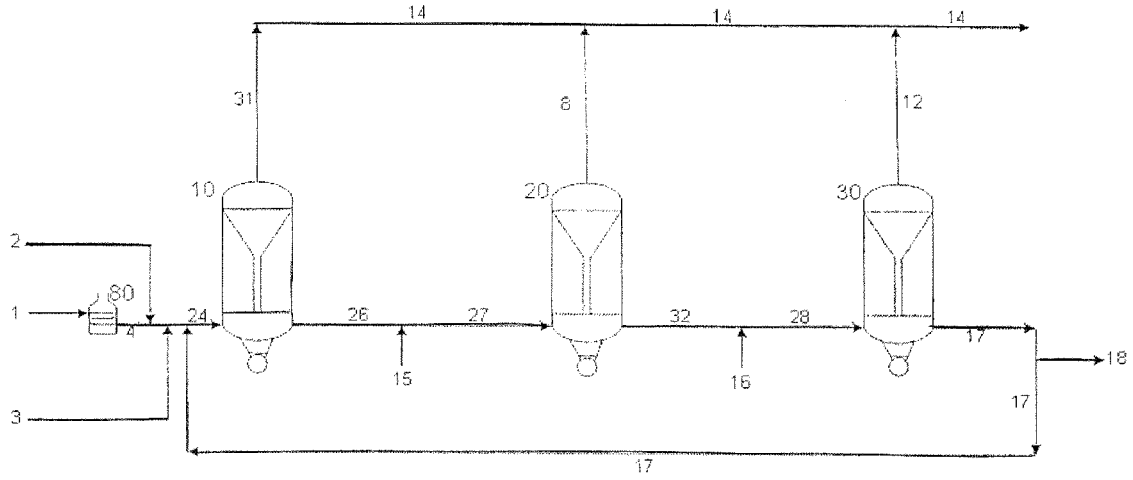

The instant invention is directed to a process for catalyst activated slurry hydrocracking. Interstage separation of gaseous reaction products and liquid streams comprising unconverted oil and catalyst is effective in maintaining heat balance in the process. In the FIGURE, stream 1 comprises a heavy feed, such as vacuum residuum. Other feeds may include atmospheric residuum, vacuum residuum, tar from a solvent deasphalting unit, atmospheric gas oils, vacuum gas oils, deasphalted oils, olefins, oils derived from tar sands or bitumen, oils derived from coal, heavy crude oils, synthetic oils from Fischer-Tropsch processes, and oils derived from recycled oil wastes and polymers.

The feed enters furnace 80 where it is heated, exiting in stream 4. Stream 4 combines with a hydrogen containing gas (stream 2), recycle slurry (stream 17), and a stream comprising an active slurry composition (stream 3), resulting in a mixture (stream 24). Stream 24 enters the bottom of the first reactor 10. Vapor Stream 31 exits the top of the reactor comprising primarily reaction products and hydrogen, due to a separation apparatus inside the reactor (not shown). Liquid stream 26, which contains slurry in combination with unconverted oil, exits the bottom, or side, of reactor 10.

Stream 26 is combined with a gaseous stream comprising hydrogen (steam 15) to create stream 27. Stream 27 enters the bottom of second reactor 20.

Vapor stream 8, comprising primarily reaction products and hydrogen, exits the top of the reactor 20 and joins the vapor product from reactor 20. Liquid stream 27, which contains slurry in combination with unconverted oil, exits the bottom, or side, of reactor 20.

Stream 32 is combined with a gaseous stream comprising hydrogen (stream 16) to create stream 28. Stream 28 enters the bottom of reactor 30. Vapor stream 12, comprising primarily reaction products and hydrogen, exits the top of the reactor and joins the vapor product from the first two reactors in stream 14. Liquid stream 17, which contains slurry in combination with unconverted oil, exits the bottom, or side, of reactor 30. A portion of this stream may be drawn off as stream 18 or recycled back to the first reactor 10, as stream 17.

Overhead streams from reactors 10, 20 and 30 (streams 31, 8 and 12 respectively) create stream 14, which passes to downstream equipment for further processing.

The preferred type of reactor in the instant invention is a liquid recirculating reactor, although other types of upflow reactors may be employed. Liquid recirculating reactors are discussed further in copending application Ser. No. 11/305,359 or US Patent Publication No. US2007140927 (T-6493), which is incorporated by reference.

A liquid recirculation reactor is an upflow reactor which feeds heavy hydrocarbon oil and a hydrogen rich gas at elevated pressure and temperature for hydroconversion. Process conditions for the liquid recirculating reactor include pressures in the range from 1500 through 3500 psia, preferably 2000 through 3000 psia. Temperatures are in the range from 700 through 900 F, preferably 775 through 850 F.

Hydroconversion includes processes such as hydrocracking and the removal of heteroatom contaminants (such sulfur and nitrogen). In slurry catalyst use, catalyst particles are extremely small (1-10 micron). Pumps may be used for recirculation of slurry, although they not required to be used.

The process for the preparation of the catalyst slurry composition used in this invention is set forth in U.S. Ser. No. 10/938,003 and U.S. Ser. No. 10/938,202 and is incorporated by reference. The catalyst composition is useful for but not limited to hydrogenation upgrading processes such as hydrocracking, hydrotreating, hydrodesulphurization, hydrodenitrification, and hydrodemetallization.

What is claimed is:

1. A process for the hydroconversion of heavy oils, said process comprising the following steps:

(a) providing at least two upflow reactors, a first reactor and a second reactor, with a separator located internally in at least one reactor;

(b) combining a heated heavy oil feed, an active slurry catalyst composition having particle sizes of 1-10 micron and a hydrogen-containing gas to form a mixture;

(c) passing the mixture of step (b) to the bottom of the first reactor, which is maintained at a temperature from 700 to 900 F and a pressure from 1500 to 3500 psia;

(d) separating internally in the first reactor a stream comprising reaction product, hydrogen gases, unconverted material and slurry catalyst into two streams, a vapor stream comprising reactor products and hydrogen, and a liquid stream comprising unconverted material and slurry catalyst;

(e) passing the vapor stream overhead to further processing, and passing the liquid stream, comprising unconverted material and slurry catalyst, from the first reactor as a bottoms stream;

(f) passing at least a portion of the liquid stream of step (e) to the bottom of the second reactor, which is maintained at hydroprocessing conditions, including elevated temperature and pressure;

(g) separating internally in the second reactor a stream comprising reaction product, hydrogen gases, unconverted material and slurry catalyst into two streams, a vapor stream comprising reactor products and hydrogen, and a liquid stream comprising unconverted material and slurry catalyst;

(h) passing the vapor stream overhead to further processing, and passing the liquid stream, comprising unconverted material and slurry catalyst, from the second reactor as a bottoms stream to further processing;

wherein the heavy oil is selected from the group consisting of atmospheric residuum, vacuum residuum, tar from a solvent deasphlating unit, oils derived from tar sands or bitumen, oils derived from coal, heavy crude oils, and oils derived from recycled oil wastes and polymers.

2. The process of claim 1, wherein the liquid stream of step (h) is recycled to step (b), the mixture of step (b) further comprising recycled unconverted material and slurry catalyst.

3. The process of claim 1, in which the upflow reactor is a recirculating reactor which employs a pump for recirculating of the slurry.

4. The process of claim 1, in which the pressure is from 2000 through 3000 psia and the temperature is from 775 through 850 F.

5. The hydroconversion process of claim 1, wherein the process is selected from the group consisting of hydrocracking, hydrotreating, hydrodesulphurization, hydrodenitrification, and hydrodemetalization.

6. The process of claim 1, wherein the active slurry catalyst composition of claim 1 is prepared by the following steps:

(a) mixing a Group VIB metal oxide and aqueous ammonia to form a Group VIB metal compound aqueous mixture;

(b) sulfiding, in an initial reaction zone, the aqueous mixture of step (a) with a gas comprising hydrogen sulfide to a dosage greater than 8 SCF of hydrogen sulfide per pound of Group VIB metal to form a slurry;

(c) promoting the slurry with a Group VIII metal compound;

(d) mixing the slurry of step (c) with a hydrocarbon oil having a viscosity of at least 2 cSt@ 212° F. to form an intermediate mixture;

(e) combining the intermediate mixture with hydrogen gas in a second reaction zone, under conditions which maintain the water in the intermediate mixture in a liquid phase, thereby forming an active catalyst composition admixed with a liquid hydrocarbon; and (f) recovering the active catalyst composition.

7. The process of claim 1, in which at least 90 wt % of the feed is converted to lower boiling products.

* * * * *